US005318000A

United States Patent [19]

Binnewies et al.

[11] Patent Number: 5,318,000

[45] Date of Patent: Jun. 7, 1994

[54] DEVICE FOR ADJUSTING THE THROTTLE VALVE OF AN INTERNAL COMBUSTION ENGINE AND METHOD FOR TESTING THE DEVICE

[75] Inventors: Ludwig Binnewies, Lappersdorf; Udo Frinzel, Grünthal; Joachim Kuhn, München, all of Fed. Rep. of Germany

[73] Assignee: Siemens Aktiengesellschaft, Munich, Fed. Rep. of Germany

[21] Appl. No.: 979,838

[22] Filed: Nov. 23, 1992

[30] Foreign Application Priority Data

May 23, 1990 [EP] European Pat. Off. ..... 90 109 818.6

[51] Int. Cl.[5] ..... F02D 11/10; F02D 41/22

[52] U.S. Cl. ..... 123/399; 74/513

[58] Field of Search ..... 123/361, 399; 74/512, 74/513, 560; 180/335

[56] References Cited

U.S. PATENT DOCUMENTS

| | | | |
|---|---|---|---|
| 4,237,752 | 12/1980 | Hildebrecht | 74/513 X |
| 4,505,357 | 3/1985 | Pfalzgraf et al. | 180/335 |
| 4,574,757 | 3/1986 | Schulman et al. | 74/513 X |
| 4,640,248 | 2/1987 | Stoltman | 123/399 |
| 4,791,900 | 12/1988 | Buck et al. | 123/359 |
| 4,819,597 | 4/1989 | Gale et al. | 123/399 |
| 4,869,220 | 9/1989 | Imoehl | 123/399 |
| 4,987,872 | 1/1991 | Geselle et al. | 123/399 X |
| 5,117,791 | 6/1992 | Chan et al. | 123/399 X |
| 5,193,506 | 3/1993 | Ironside et al. | 123/399 |
| 5,233,530 | 8/1993 | Shimada et al. | 123/399 X |

FOREIGN PATENT DOCUMENTS

| | | |
|---|---|---|
| 0106011 | 4/1984 | European Pat. Off. . |
| 0213349 | 3/1987 | European Pat. Off. . |
| 0269118 | 6/1988 | European Pat. Off. . |
| 3812760 | 10/1989 | Fed. Rep. of Germany . |

*Primary Examiner*—Willis R. Wolfe

*Attorney, Agent, or Firm*—Herbert L. Lerner; Laurence A. Greenberg

[57] ABSTRACT

A throttle valve of an internal combustion engine can be adjusted by an electrical system. A device and a method for adjusting the throttle valve include a set value signal generator which has a no-load switch and a full-load switch. By evaluating the position of these two switches, the desire of the driver to set full-load or no-load can be reliably detected and accordingly taken into account even when the set value signal generator is blocked.

18 Claims, 2 Drawing Sheets

DEVICE FOR ADJUSTING THE THROTTLE VALVE OF AN INTERNAL COMBUSTION ENGINE AND METHOD FOR TESTING THE DEVICE

CROSS-REFERENCE TO RELATED APPLICATIONS

This application is a Continuation of International application Ser. No. PCT/EP91/00906, filed May 15, 1991., now WO 91/18195.

The invention relates to a device for adjusting the throttle valve of an internal combustion engine, including a set value signal generator having an accelerator pedal and two position signal generators connected thereto, each outputting a set value signal characterizing the position of the accelerator pedal, and a control unit driving an actuation element for the adjustment of the throttle valve as a function of the set value signals.

In such a device the throttle valve is adjusted by an electromotive actuation element which is driven by a control unit. For this purpose, the control unit receives a set value for setting the throttle valve from a set value signal generator which has an accelerator pedal and two position signal generators connected thereto. The two position signal generators are usually potentiometers which have a common slide that taps off two separate resistance tracks.

The operational reliability of the device is thus substantially increased since the two potentiometers can be tested with respect to one another. A defect in one of the two potentiometers can be detected from the deviation of the output signals.

A further safety problem in such a device is the possible blocking of the set value signal generator. The blocking cannot be detected through the two potentiometers. In addition, when blocking occurs it is no longer possible to change the throttle valve position through the accelerator pedal. If the blocking occurs during an overtaking procedure, the driver can no longer accelerate or if he or she takes his or her foot off the accelerator pedal, the throttle valve no longer returns to the no-load position.

It is accordingly an object of the invention to provide a device for adjusting the throttle valve of an internal combustion engine and a method for testing the device, which overcome the hereinafore-mentioned disadvantages of the heretofore-known devices and methods of this general type and which do so in such a way that, even when the accelerator pedal is blocked, the desire of the driver to set full-load or no-load can be reliably detected and set.

With the foregoing and other objects in view there is provided, in accordance with the invention, a device for adjusting the throttle valve of an internal combustion engine, comprising a set value signal generator having an accelerator pedal and two position signal generators each being connected to the accelerator pedal for outputting a set value signal characterizing a position of the accelerator pedal, a control unit connected to the set value signal generator, an actuation element being driven by the control unit for adjusting a throttle valve of an internal combustion engine as a function of the set value signals, a no-load switch disposed at the set value signal generator for responding when the accelerator pedal is touched, even before the position signal generators change position, and a full-load switch disposed at the set value signal generator for responding to a specific pressure exerted on the accelerator pedal being greater than a pressure being necessary for keeping the accelerator pedal in a specific position and for moving the accelerator pedal into another position, and the control unit setting the throttle valve in accordance with positions of the no-load switch and of the full-load switch, into a no-load position when the no-load switch and the full-load switch have not responded, and into a full-load position when the no-load switch and the full-load switch have responded.

According to the invention, a no-load switch and a full-load switch are provided on the set value signal generator. The no-load switch responds when the accelerator pedal is touched, that is to say as soon as the driver puts his or her foot on the accelerator pedal and before the set value which has been output changes. The full-load switch responds when there is increased pressure on the accelerator pedal. The level of this pressure is selected in such a way that it is always greater than the pressure which is necessary to hold the accelerator pedal in a specific position or to move it into another position. The full-load switch therefore only responds when the driver presses against the full-load stop or against a blocked accelerator pedal.

When the set value signal generator is blocked, there are two cases to be differentiated. If the driver wishes to carry on accelerating the vehicle, e.g. during an overtaking procedure, he or she presses with increased pressure on the accelerator pedal. Thus, the no-load and the full-load switch have responded and the control unit switches the throttle valve into the full-load position. If, on the other hand, the driver takes his or her foot off the accelerator pedal, thus wanting no-load to be set, neither the no-load nor the full-load switch are actuated. In this case, the control unit switches the throttle valve into the no-load position.

An allowance is therefore made for the desire of the driver to set full-load or no-load, although the set value signal generator is blocked and thus the set value signals from the potentiometers always remain the same. Increased safety, e.g. for the critical case of full-load, is provided by the use of two switches. Full-load and no-load are only set if either both switches have responded or both switches have not responded.

In accordance with another feature of the invention, the throttle valve is only switched into the full-load or no-load position when the so-called single-fault criterion is fulfilled. If blocking of the accelerator pedal occurs, a fault is already present. In the case of each further fault in the system, the number of combinations of possible faults is multiplied. Therefore, full-load or no-load is only set when the two potentiometers indicate the same position of the accelerator pedal, since otherwise a further fault is present in one of the potentiometers.

In accordance with a further feature of the invention, a test is performed as to whether or not the position signals of the potentiometers have changed within a specific time interval. When such a change occurs, blocking is then in fact no longer occurring so that full-load in particular may no longer be set.

In accordance with an added feature of the invention, safety can be increased once more if one or more brake switches which respond when the brake pedal is actuated are included in the system. If the driver actuates the brake, it can be assumed that he or she does not desire to set full-load under any circumstances but rather no-load. Therefore, in this case the throttle valve is switched into the no-load position irrespective of the position of the other switches.

In accordance with an additional feature of the invention, the full-load switch additionally has a pressure sensor having an output signal which is proportional to the pressure exerted on the accelerator pedal. By comparing these output signals, a two out of three redundancy with respect to the two throttle valve potentiometers can be achieved.

In accordance with yet another feature of the invention, the output signals are conducted from the opposite threshold value switch which is set to the pressure limit value of the full-load switch, and the function of the full-load switch can be tested.

In accordance with another mode of the invention, in normal driving operation of the vehicle, there is provided a method which comprises testing all of the switches and position signal generators described above with respect to one another for plausibility.

In accordance with a further mode of the invention, if an implausible combination occurs in this case, there is provided a method which comprises selecting that component having a position or switching state which contradicts that of the other components, as being defective.

In accordance with a concomitant mode of the invention, there is provided a method which comprises maintaining emergency operation in this case, on the basis of the remaining intact components.

Other features which are considered as characteristic for the invention are set forth in the appended claims.

Although the invention is illustrated and described herein as embodied in a device for adjusting the throttle valve of an internal combustion engine and a method for testing the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
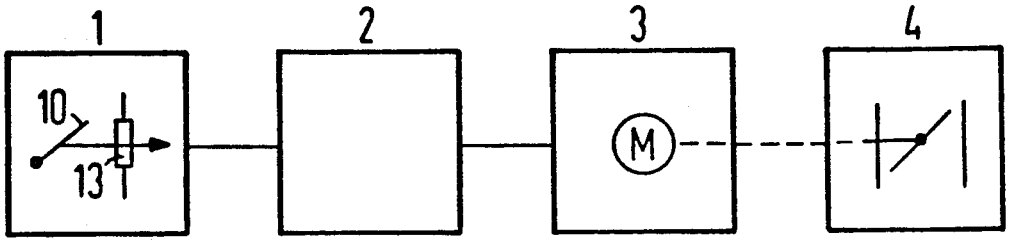
FIG. 1 is a schematic and block circuit diagram of a device for adjusting a throttle valve of an internal combustion engine.

Referring now to the figures of the drawing in detail and first, particularly, to FIG. 1 thereof, there is seen a set value signal generator which is designated by reference numeral 1. This set value signal generator 1 essentially contains an accelerator pedal 10 and a potentiometer 13 which outputs the position of the accelerator pedal 10 as a set value to a control unit 2. The control unit 2 is a microcomputer which performs a calculation on the set value signal and outputs a corresponding actuation signal for an actuation element 3. The actuation element 3 is an electric motor which is directly connected to a throttle valve 4 and adjusts the latter in accordance with the actuation signal.

Figure 2:
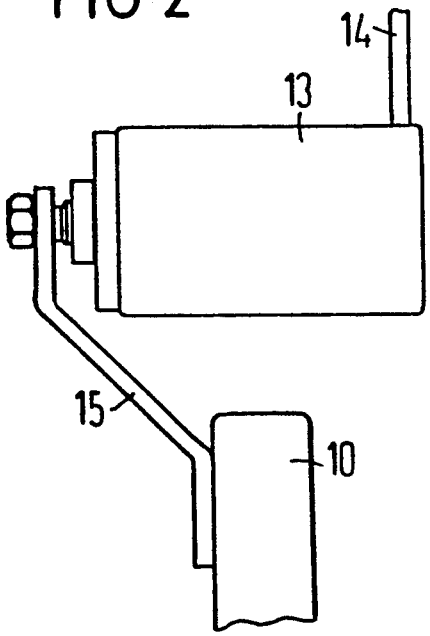
FIGS. 2 and 3 are two fragmentary, diagrammatic, elevational views of a set value signal generator.
Figure 3:
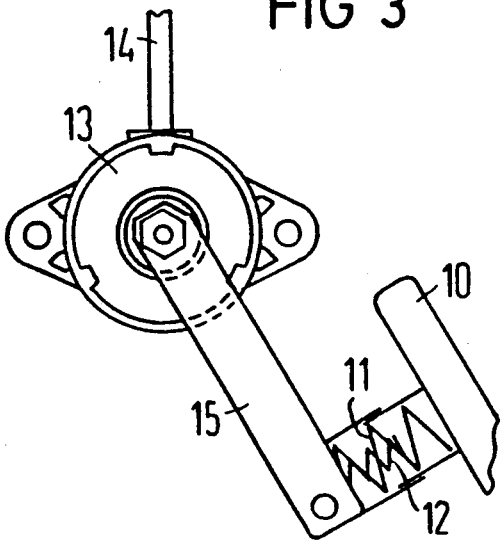

FIGS. 2 and 3 show two views of the set value signal generator 1. The potentiometer 13 is a rotary potentiometer which is adjusted by a lever 15. Disposed inside a cylindrical housing of the potentiometer 13 are two resistance tracks which extend annularly independently of one another. A common slide which is connected to the lever arm 15 so as to be fixed in terms of rotation, taps off each of the two resistance tracks through a respective contact. The two contacts are electrically insulated from one another so that the effect of two potentiometers or position signal generators is achieved with the two separate resistance tracks.

The two resistance tracks are connected in opposite directions. In other words, the position of the slide which signifies the largest resistance value in one potentiometer signifies the smallest resistance value in the other potentiometer. As a result, a simple means of monitoring is provided since the sum of the two resistance values must always correspond to the maximum value of a potentiometer.

The lever arm 15 is moved by the foot of the driver through the accelerator pedal 10, in the direction of rotation shown in FIG. 3. In this case, the respective position is detected by the potentiometer 13 and is fed to the control unit 2 as an electrical signal through feed lines 14.

A no-load switch 11 and a full-load switch 12 are provided on the lever arm 15. The two switches are located between the accelerator pedal 10 and the lever arm 15 and they are both constructed as push-button keys which only differ in the actuation force required.

The no-load switch 11 is constructed in this case in such a way that when the accelerator pedal 10 is actuated, it responds even before the lever arm 15 moves. A response of the no-load switch 11 therefore means that the driver has placed his or her foot on the accelerator pedal 10 but the level arm 15 has not yet moved out of a no-load position.

On the other hand, the full-load switch 12 is constructed in such a way that it does not respond until the accelerator pedal 10 is depressed with a further increased force after a full-load stop has been reached. The full-load switch 12 thus also responds when the lever arm 15 is blocked in any position and the driver presses on the accelerator pedal 10 with increased force.

Figure 4:
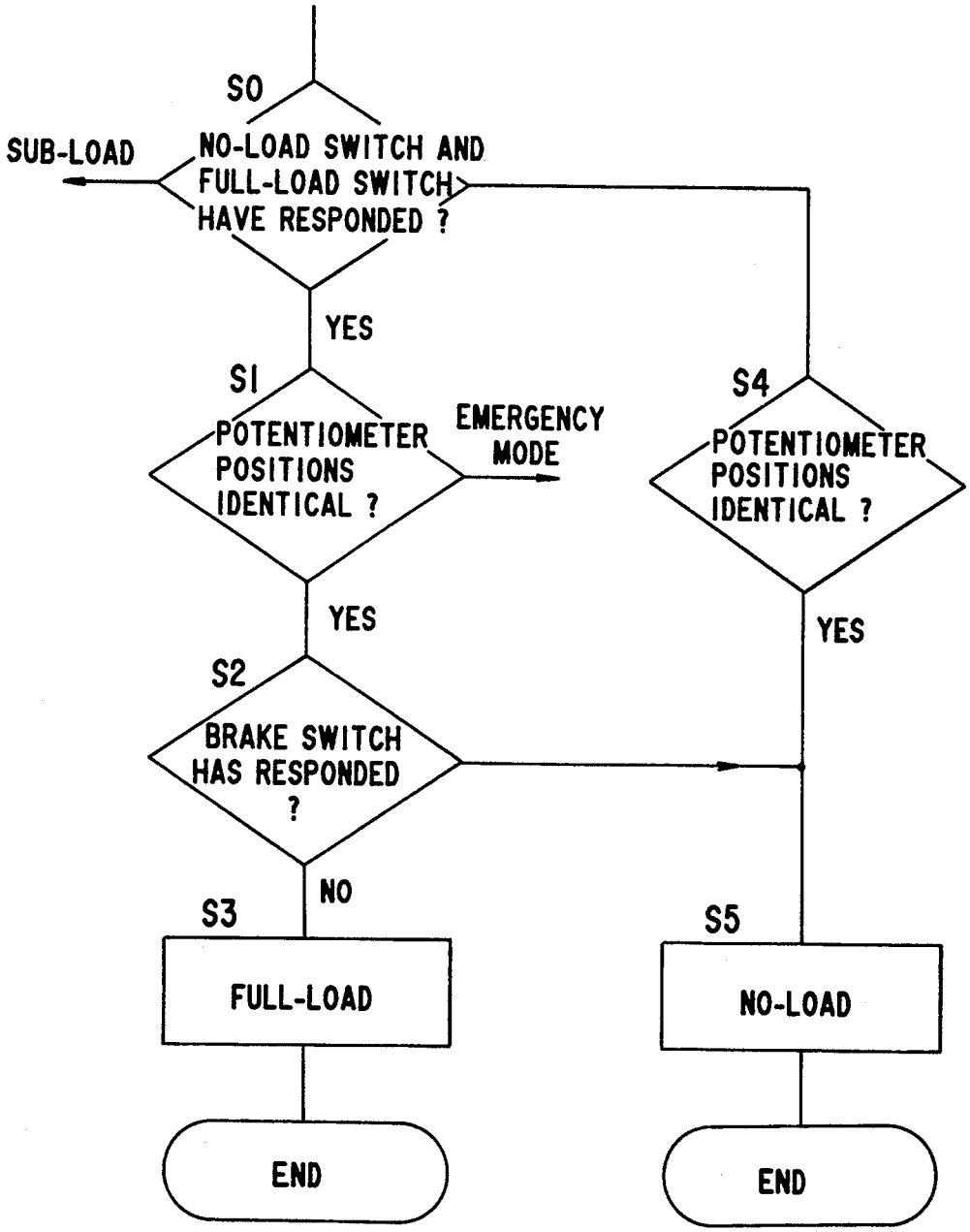
FIG. 4 is a flow diagram used for illustrating the mode of operation in the case of blocking of the set value signal generator.

FIG. 4 shows part of the processing routine which is stored in the control unit 2 and is actuated in the event of blocking of the set value signal generator.

In a first case it will be assumed that the set value signal generator 1 is suddenly blocked during an overtaking or passing procedure. The driver continues to press on the accelerator pedal 10 since he or she requires even more engine power in order to be sure of completing the overtaking procedure.

In a step S0, in the case of each calculation routine for a new actuation signal to set the throttle valve 4, a test is performed as to whether or not the no-load switch 11 and the full-load switch 12 have both responded. Since this occurs in the above-mentioned first case, a step S1 follows with a test as to whether or not the same position of the lever arm 15 has been determined through the two resistance tracks of the potentiometer 13. If this is not the case, a branching occurs to an emergency program which only permits the internal combustion engine to continue operating at restricted power. This power restriction is necessary since in this case one of the two potentiometers is defective and thus a no-longer definable fault state is present.

If the two potentiometers agree, a step S2 follows, in which the response of two switches attached to the brake pedal is tested. A first one of the two switches is the customary brake light switch. A second one of the two switches is also actuated with the brake pedal, like the brake light switch, and only serves to increase safety. Therefore, if the switch responds, this means that the driver is braking. In this case, it is assumed that it is not desired to set to full-load but rather to no-load and in a step S5 the throttle valve is adjusted into the no-load position. If, on the other hand, the brake is not actuated, in a step S3 the throttle valve 4 is adjusted into the full-load setting. It is to be noted that the steps S0 to S3 proceed identically, irrespective of whether the throttle is completely opened during normal, fault-free driving operation or whether it is desired to set to full-load by means of further pressure on the accelerator pedal 10 when the set value signal generator 1 is blocked. The steps S1 and S2 in this case serve to test whether or not a state is present which is critical in terms of safety and does not permit a full-load signal generator.

In a second case, it will be assumed that the set value signal generator is blocked when the throttle is being closed and the driver takes his or her foot off the accelerator pedal 10.

In this case, it is detected at the step S0 that neither the no-load switch 11 nor the full-load switch 12 have responded.

In a step S4, a test is then again performed as to whether or not the two potentiometers agree. In the negative case, the emergency program then follows again and in the positive case the throttle valve 4 is adjusted into the no-load position at the step S5. In this case as well, the routine proceeds identically, irrespective of whether or not it is a normal, fault-free no-load case or whether or not the set value signal generator 1 is blocked and the driver desires to set no-load by taking his or her foot off the accelerator pedal 10.

A particular advantage of the system according to the invention is the possibility of mutual testing of the individual switches and potentiometers. Only a few examples of such tests will be mentioned herein:

in every sub-load case the no-load switch 11 must have responded;

if the no-load switch 11 is not actuated, the two potentiometers must indicate the no-load position of the throttle valve 4;

whenever full-load is set the full-load switch 12 must respond;

the two brake switches may only respond together; and the two potentiometers must always indicate the same position.

We claim:

1. A device for adjusting the throttle valve of an internal combustion engine, comprising:

a set value signal generator having an accelerator pedal and two position signal generators each being connected to said accelerator pedal for outputting a set value signal characterizing a position of said accelerator pedal, a control unit connected to said set value signal generator, an actuation element being driven by said control unit for adjusting a throttle valve of an internal combustion engine as a function of the set value signals, a no-load switch disposed at said set value signal generator for responding when said accelerator pedal is touched, even before said position signal generators change position, and a full-load switch disposed at said set value signal generator for responding to a specific pressure exerted on said accelerator pedal being greater than a pressure being necessary for keeping said accelerator pedal in a specific position and for moving said accelerator pedal into another position, and said control unit setting the throttle valve in accordance with positions of said no-load switch and of said full-load switch, into a no-load position when said no-load switch and said full-load switch have not responded, and into a full-load position when said no-load switch and said full-load switch have responded.

2. The device according to claim 1, wherein said control unit only switches the throttle valve into the no-load and into the full-load position when position signals of said two position signal generators indicate an identical position of said accelerator pedal.

3. The device according to claim 1, wherein said control unit only switches the throttle valve into the no-load and into the full-load position when position signals of said two position signal generators have not changed within a specific time interval.

4. The device according to claim 1, including at least one brake switch being disposed at said brake pedal and responding when a brake is actuated, said control unit switching the throttle valve into the no-load position when said brake switch has responded.

5. The device according to claim 1, wherein said full-load switch has a pressure sensor issuing an output signal being proportional to pressure exerted on said accelerator pedal.

6. The device according to claim 5, including a threshold value switch for receiving the output signals, said threshold value switch having a threshold value being set to a pressure limit value of said full-load switch.

7. The device according to claim 4, including means connected to said no-load switch, to said full-load switch, to said brake switch and to said two position signal generators, for testing signals output by said no-load switch, said full-load switch, said brake switch and said two position signal generators during a driving operation, for plausibility.

8. The device according to claim 7, wherein said testing means assumes that there is a fault in a component having a signal with a significance that contradicts that of a plurality of other components, in the case of an implausible combination.

9. The device according to claim 8, wherein said testing means maintains operation on the basis of remaining components as an emergency operation at restricted power, when a fault is detected in a component.

10. A method for adjusting the throttle valve of an internal combustion engine, which comprises:

outputting a set value signal from each of two position signal generators being connected to an accelerator pedal of a set value signal generator, for characterizing a position of the accelerator pedal, driving an actuation element with a control unit connected to the set value signal generator, for adjusting a throttle valve of an internal combustion engine as a function of the set value signals, issuing a response from a no-load switch disposed at the set value signal generator when the accelerator pedal is touched, even before the position signal generators change position, issuing a response from a full-load switch disposed at the set value signal generator to a specific pressure exerted on the accelerator pedal being greater than a pressure being necessary for keeping the accelerator pedal in a specific position and for moving the accelerator pedal into another position, and setting the throttle valve with the control unit in accordance with positions of the no-load switch and of the full-load switch, into a no-load position when the no-load switch and the full-load switch have not responded, and into a full-load position when the no-load switch and the full-load switch have responded,

11. The method according to claim 10, which comprises switching the throttle valve into the no-load and into the full-load position with the control unit only when position signals of the two position signal generators indicate an identical position of the accelerator pedal.

12. The method according to claim 10, which comprises switching the throttle valve into the no-load and into the full-load position with the control unit only when position signals of the two position signal generators have not changed within a specific time interval.

13. The method according to claim 10, which comprises issuing a response from at least one brake switch disposed at the brake pedal when a brake is actuated, and switching the throttle valve into the no-load position with the control unit when the brake switch has responded.

14. The method according to claim 10, which comprises issuing an output signal being proportional to pressure exerted on the accelerator pedal with a pressure sensor of the full-load switch.

15. The method according to claim 14, which comprises setting a threshold value of a threshold value switch for receiving the output signals to a pressure limit value of the full-load switch.

16. The method according to claim 13, which comprises testing signals output by the no-load switch, the full-load switch, the brake switch and the two position signal generators for plausibility during a driving operation.

17. The method according to claim 16, which comprises assuming that there is a fault in a component having a signal with a significance that contradicts that of a plurality of other components, in the case of an implausible combination.

18. The method according to claim 17, which comprises maintaining operation on the basis of remaining components as an emergency operation at restricted power, when a fault is detected in a component.

* * * * *